US007526229B1

(12) United States Patent
Liu et al.

(10) Patent No.: US 7,526,229 B1
(45) Date of Patent: Apr. 28, 2009

(54) BELT TENSION MECHANISM OF AN IMAGE FORMING DEVICE

(75) Inventors: Dean Liu, Hsinchu (TW); Yi-Long Lee, Hsinchu (TW)

(73) Assignee: Aetas Technology Incorporated, Irvine, CA (US)

( * ) Notice: Subject to any disclaimer, the term of this patent is extended or adjusted under 35 U.S.C. 154(b) by 11 days.

(21) Appl. No.: 11/965,724

(22) Filed: Dec. 27, 2007

(51) Int. Cl.
*G03G 15/00* (2006.01)

(52) U.S. Cl. ..... 399/165; 399/162

(58) Field of Classification Search ..... 399/159, 399/162, 165, 167
See application file for complete search history.

(56) References Cited

U.S. PATENT DOCUMENTS

| | | | | |
|---|---|---|---|---|
| 5,313,259 | A | 5/1994 | Smith | |
| 6,055,396 | A * | 4/2000 | Pang | 399/164 |
| 6,477,349 | B2 * | 11/2002 | Kanekura et al. | 399/302 |
| 6,711,367 | B2 * | 3/2004 | Saito et al. | 399/121 |
| 6,865,364 | B2 * | 3/2005 | Matsumoto | 399/329 |
| 7,024,136 | B2 | 4/2006 | Fiore et al. | |
| 7,155,144 | B2 | 12/2006 | Atwood et al. | |
| 7,424,251 | B2 * | 9/2008 | Watanabe et al. | 399/165 |
| 2005/0002693 | A1 | 1/2005 | Pak et al. | |
| 2006/0024088 | A1 | 2/2006 | Atwood et al. | |
| 2006/0120757 | A1 | 6/2006 | Park et al. | |
| 2007/0147894 | A1 * | 6/2007 | Yokota | 399/165 |

* cited by examiner

*Primary Examiner*—Jong-Suk (James) Lee
*Assistant Examiner*—David R Crowe
(74) *Attorney, Agent, or Firm*—Winston Hsu

(57) ABSTRACT

A belt tension mechanism includes a tension roller disposed on a side of a photoconductive belt for pressing the photoconductive belt, a first elastic component connected to the tension roller for providing the elastic force to the tension roller, and a releasing device disposed on the other side of the photoconductive belt. The releasing device includes a actuating component for moving in a first direction and separating from the tension roller when being electrified so that the first elastic component can drive the tension roller to a position where the tension roller can press the photoconductive belt, and a second elastic component connected to the actuating component for driving the actuating component to a second direction opposite to the first direction when the actuating component is not electrified so that the actuating component can drive the tension roller to a position where the tension roller cannot press the photoconductive belt.

19 Claims, 10 Drawing Sheets

BELT TENSION MECHANISM OF AN IMAGE FORMING DEVICE

BACKGROUND OF THE INVENTION

1. Field of the Invention

The present invention relates to a belt tension mechanism capable of providing tension to a photoconductive belt and a related image forming device, and more particularly, to a belt tension mechanism capable of releasing tension of a photoconductive belt when being not electrified and a related image forming device.

2. Description of the Prior Art

Please refer to FIG. 1. FIG. 1 is a diagram of an image forming device 10 in the prior art. The image forming device 10 can be a printer, a multi-functional product, and so on. The image forming device 10 includes a housing 12 for covering inner components of the image forming device 10, a photoconductive belt 14, a charger 16, an exposing device 18, a developing device 20, a clean device 22, a transfer roller 24, a toner fuser 26, and a discharge unit 28.

When the image-forming device prints an image, as the first step of the entire process, a charger 16 charges a surface of a photoconductive belt 14 to a charged potential. The exposing device 18 exposes the photoconductive belt 14 to form a latent image on the photoconductive belt 14. The toners stored in the developing device 20 are jumped onto the latent image to form a toner image. The transfer roller 24 transfers the toner image on a print medium, such as paper. At last, the toner fuser 26 fuses the toners on the print medium 40. The clean device 22 cleans the rest toners on the photoconductive belt 14, and the discharge unit 28 discharges the rest charged potential on the photoconductive belt 14.

The image forming procedure of the image forming device 10 operates on the photoconductive belt 14 mostly. Thus the characteristic of the photoconductive belt 14 influences print quality directly. Generally, supporting components sustain the photoconductive belt to move along a path and define the outline of the photoconductive belt 14. Please refer to FIG. 2. FIG. 2 is a diagram of the photoconductive belt 14 in the prior art. A drive roller 44 and an idle roller 46 drive the photoconductive belt 14 so as to enlarge the size of the image forming device 10. Please refer to FIG. 1. U.S. Pat. No. 5,313,259 discloses the photoconductive belt 14 moving along a triangular path so that the size of the image forming device can be reduce. A tension roller 42 is for pressing the photoconductive belt 14 so as to provide tension to the photoconductive belt 14 and sustain the photoconductive belt 14. A drive roller 44 is for driving the photoconductive belt 14 to rotate. An idle roller 46 is for sustaining the photoconductive belt 14 with the tension roller 42 and the drive roller 44 together so that the drive roller 44 is capable of driving the photoconductive belt 14 smoothly. The tension roller 42 keeps pressing the photoconductive belt 14 causing the stress and the tension inside the photoconductive belt 14, especially for long idle period of the image forming device 10. It causes torsion and deformation of the photoconductive belt 14 and results in elasticity fatigue of the photoconductive belt 14 so that the service life of the photoconductive belt 14 and the print quality of the image forming device 10 reduce.

To solve the above-mentioned problem, different releasing mechanisms are designed for separating the tension roller and the photoconductive belt so as to release the tension of the photoconductive belt when the photoconductive belt does not operate. For example, U.S. patents of publication no. 20060120757, 20050002693, 20060024088 and U.S. Pat. Nos. 7,155,144, 7,024,136 disclose releasing mechanisms for releasing the photoconductive belt. However the conventional releasing mechanisms is only capable of separating the tension roller and the photoconductive belt when being electrified. It means that the tension roller and the photoconductive belt can not be separated by the conventional releasing mechanisms when the image forming device is not electrified or shut down abnormally so that the service life of the photoconductive belt and the print quality of the image forming device reduce.

SUMMARY OF THE INVENTION

It is therefore a primary objective of the invention to provide a belt tension mechanism capable of releasing tension to a photoconductive belt when being not electrified and a related image forming device for solving the above-mentioned problem.

According to the claimed invention, a belt tension mechanism includes a tension roller disposed on a side of a photoconductive belt for pressing the photoconductive belt so as to provide tension to the photoconductive belt, a first elastic component connected to the tension roller for providing the elastic force to the tension roller so that the tension roller is capable of pressing the photoconductive belt, and a releasing device disposed on the other side of the photoconductive belt. The releasing device includes a actuating component for moving in a first direction and separating from the tension roller when being electrified so that the first elastic component can drive the tension roller to a position where the tension roller can press the photoconductive belt, and a second elastic component connected to the actuating component for driving the actuating component to a second direction opposite to the first direction when the actuating component is not electrified so that the actuating component can drive the tension roller to a position where the tension roller can not press the photoconductive belt.

According to the claimed invention, an image forming device includes a housing, a photoconductive belt installed inside the housing in a rotatable manner, a drive roller for driving the photoconductive belt to rotate, a tension roller for pressing the photoconductive belt so as to provide tension to the photoconductive belt, an idle roller for sustaining the photoconductive belt to move along a path with the tension roller and the drive roller, and a releasing mechanism disposed opposite to the photoconductive belt relative to the photoconductive belt. The releasing mechanism includes an actuating element for separating from the tension roller when the actuating element is electrified so that e the tension roller can press the photoconductive belt, and a elastic element connected to the actuating element for driving the actuating element when the actuating element is not electrified so that the actuating element drives the tension roller to a position where the tension roller can not press the photoconductive belt.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
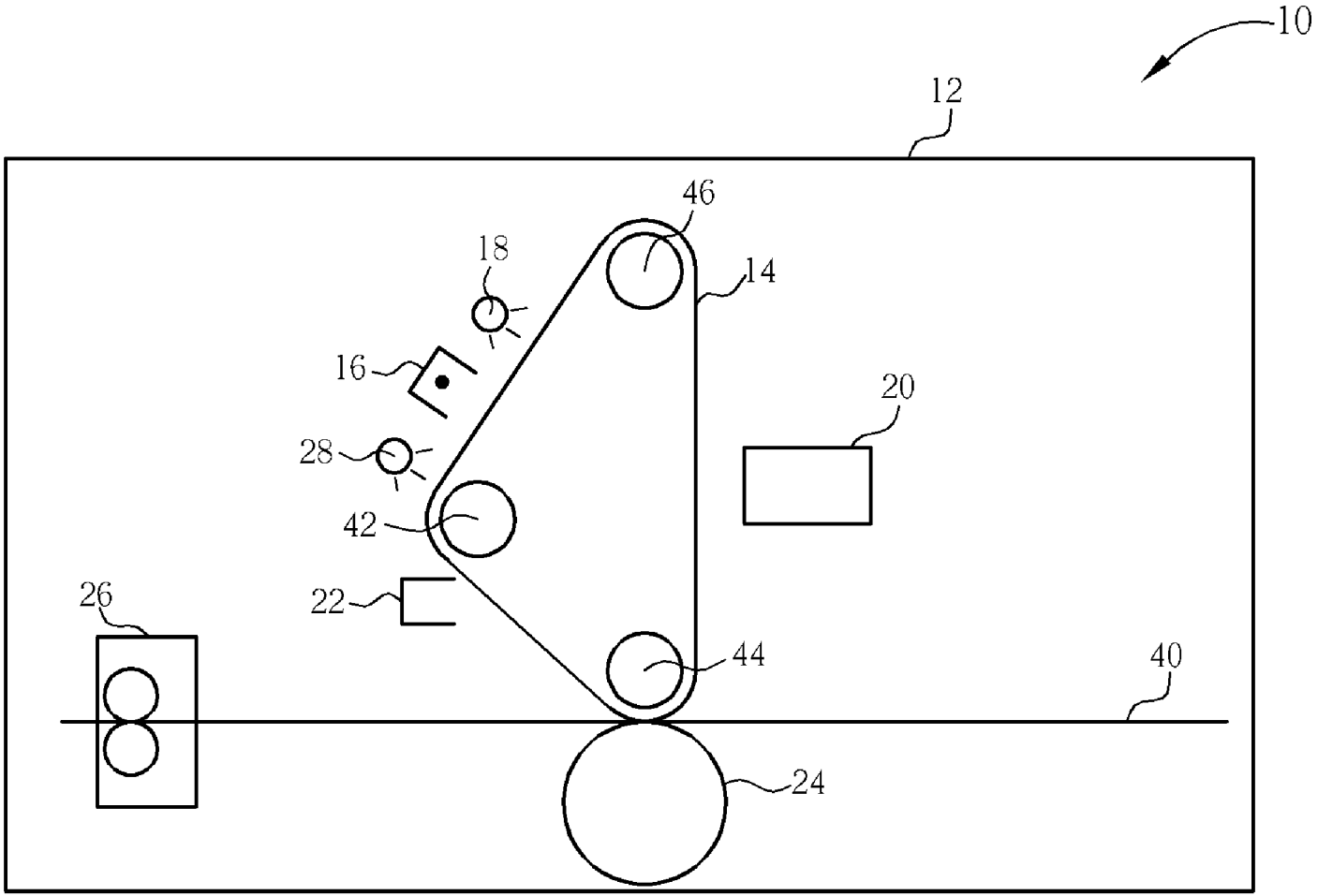
FIG. 1 PRIOR ART
FIG. 1 is a diagram of an image forming device in the prior art.
Figure 2:
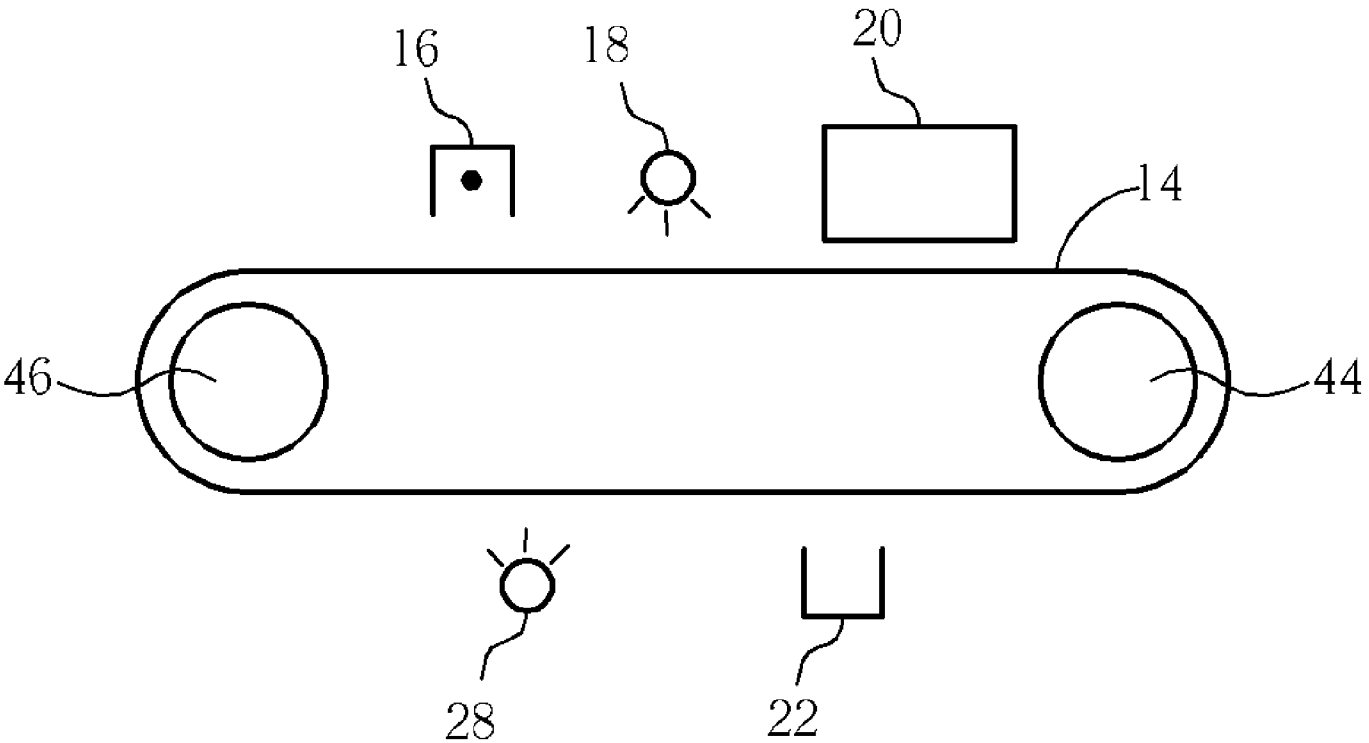
FIG. 2 PRIOR ART
FIG. 2 is a diagram of a photoconductive belt in the prior art.
Figure 3:
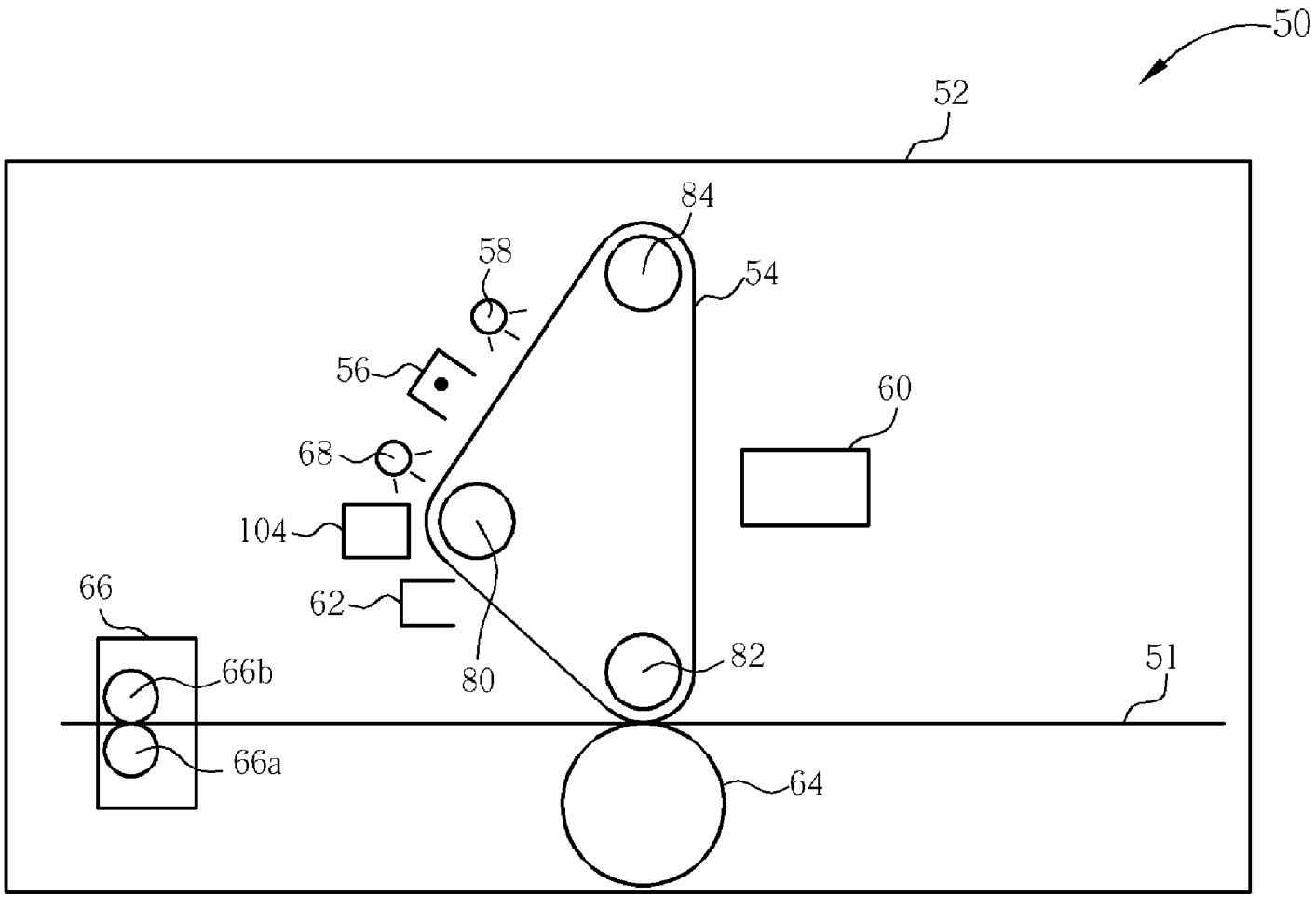
FIG. 3 is a diagram of an image forming device according to an embodiment of the present invention.

Please refer to FIG. 3. FIG. 3 is a diagram of an image forming device 50 according to an embodiment of the present invention. The image forming device 50 includes a housing 52 for covering inner components of the image forming device 50. The image forming device 50 further includes a photoconductive belt 54 installed inside the housing 52 in a rotatable manner, a charger 56 for distributing charges on the surface of the photoconductive belt 54, an exposing device 58 for exposing the photoconductive belt 54 so as to form a latent image on the photoconductive belt 54, and a developing device 60. Toners stored in the developing device 60 are jumped onto the latent image so as to form a toner image. The image forming device 50 further includes a transfer roller 64 for transferring the toner image on a print medium 51, such as paper, a toner fuser 66 including a pressure roller 66*a* and a heating roller 66*b* for fusing the toners on the print medium 51 so as to finish the image forming procedure, a clean device 62 for cleaning the rest toners on the photoconductive belt 54, and a discharge unit 68 for discharging the rest charges on the photoconductive belt 54.

Figure 4:
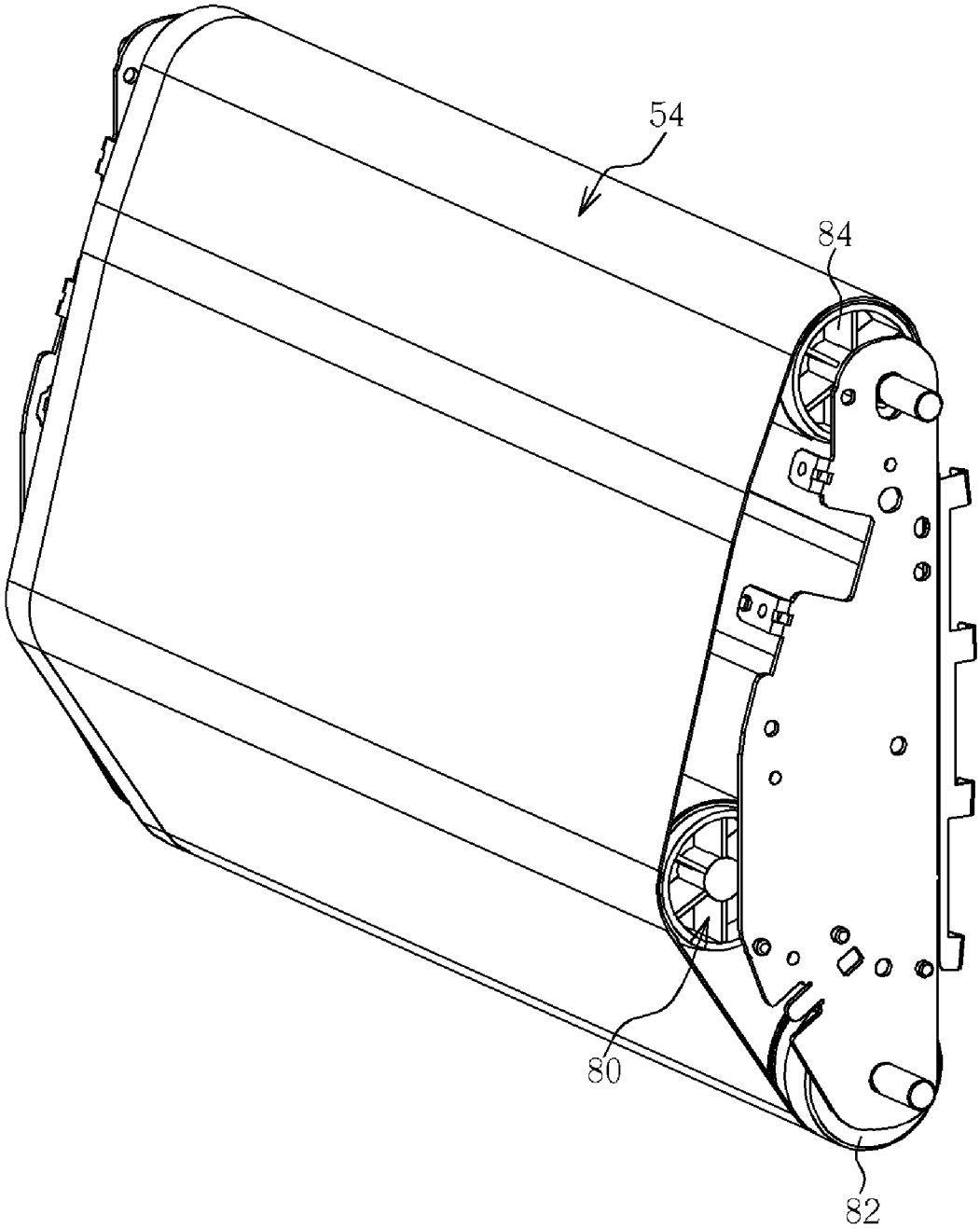
FIG. 4 is a schematic drawing of a photoconductive belt according to the embodiment of the present invention.

Please refer to FIG. 3 and FIG. 4. FIG. 4 is a schematic drawing of the photoconductive belt 54 according to the embodiment of the present invention. A tension roller 80, a drive roller 82, and an idle roller sustain the shape and the operating route of the photoconductive belt 54. The tension roller 80 can press the photoconductive belt 54 so as to provide the tension for the photoconductive belt 54. The drive roller 82 drives the photoconductive belt 54 to rotate. The idle roller 84 assists the drive roller 82 in driving the photoconductive belt 54 smoothly. When the photoconductive belt 54 operates, the tension roller 80 presses the photoconductive belt 54 for fixing the photoconductive belt 54 so that the photoconductive belt 54 can function well.

Figure 5:
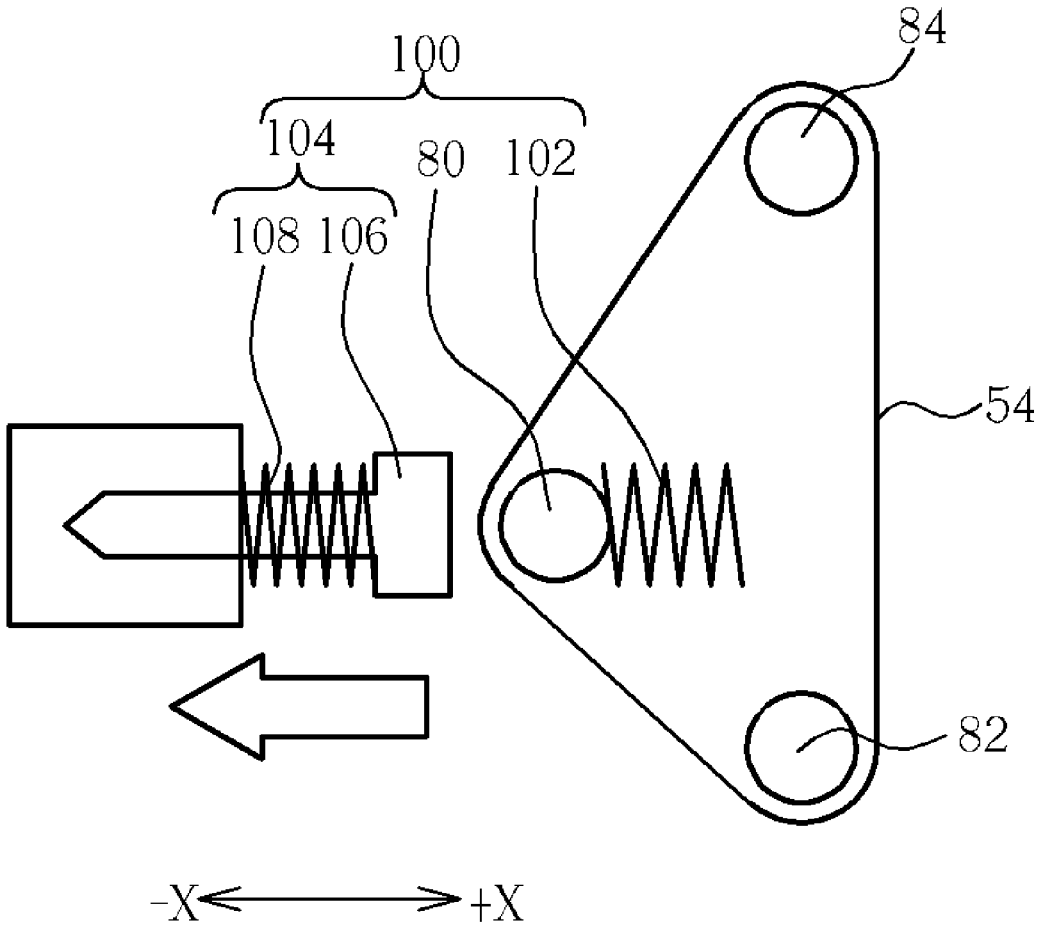
FIG. 5 is a diagram of a belt tension mechanism when the image forming device is printing according to a first embodiment of the present invention.
Figure 6:
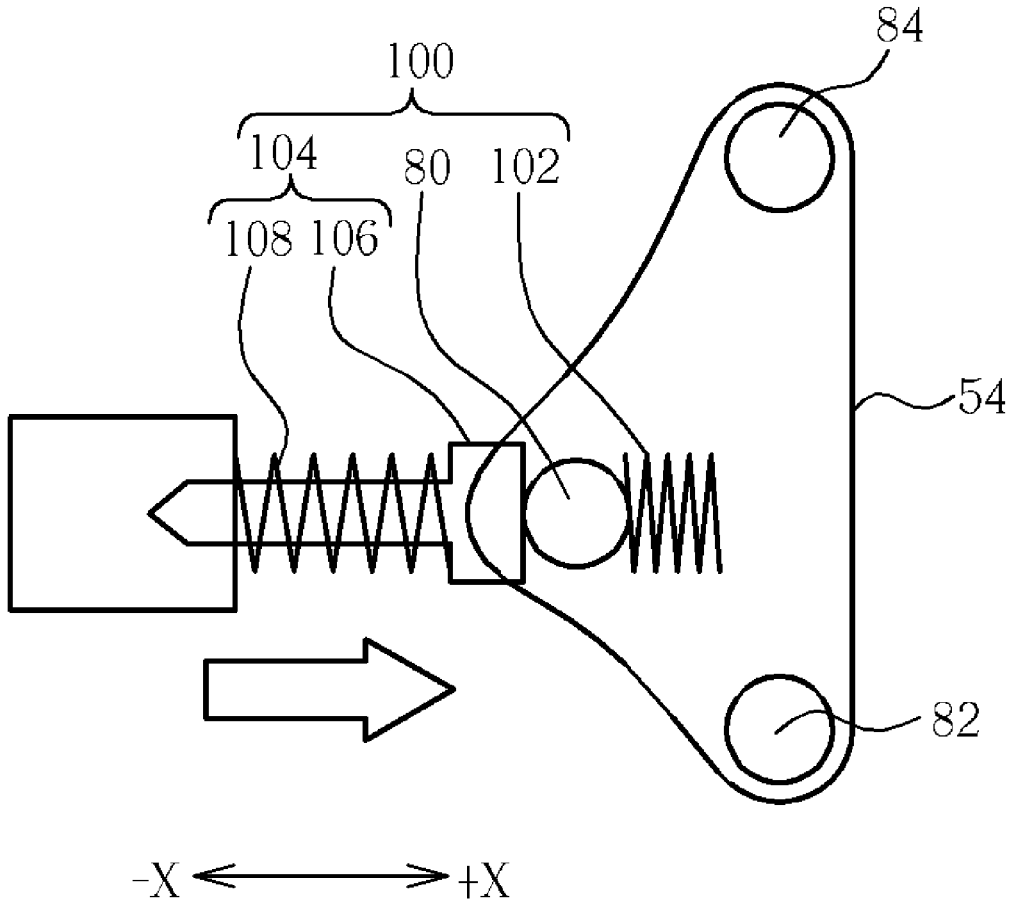
FIG. 6 is a diagram of the belt tension mechanism when the image forming device is not printing according to the first embodiment of the present invention.

Please refer to FIG. 5 and FIG. 6. FIG. 5 is a diagram of a belt tension mechanism 100 when the image forming device 50 is printing according to a first embodiment of the present invention. FIG. 6 is a diagram of the belt tension mechanism 100 when the image forming device 50 is not printing according to the first embodiment of the present invention. The belt tension mechanism 100 can be disposed on lateral sides of the photoconductive belt 54 for providing and releasing the tension of the photoconductive belt 54. The belt tension mechanism 100 includes the tension roller 80, a first elastic component 102, and a releasing mechanism 104. The tension roller 80 is disposed on a side of the photoconductive belt 54 for pressing the photoconductive belt 54 so as to provide the tension to the photoconductive belt 54. The first elastic component 102 is disposed on the side of the photoconductive belt 54 and connected to the tension roller 80 for providing elastic force to the tension roller 80 so that the tension roller 80 is capable of pressing the photoconductive belt 54. The first elastic component 102 can be a spring or a clip. The releasing mechanism 104 is disposed on the other side of the photoconductive belt 54 and includes an actuating component 106 and a second elastic component 108. The actuating component 106 can be a solenoid or a linear motor. The second elastic component 108 can be a spring or a clip.

As shown in FIG. 5, when the releasing mechanism 104 is electrified, the actuating component 106 of the releasing mechanism 104 moves in the −X direction. Because the driving force in the −X direction applied to the actuating component 106 is greater than the elastic force of the second elastic component 108, the actuating component 106 separates from the tension roller 80 and can not press the tension roller 80. For example, the actuating component 106, such as the solenoid or the linear motor, can be designed to move in the −X direction when being electrified. When the actuating component 106 is not electrified, the actuating component 106 can not move. The first elastic component 102 connected to the tension roller 80 has a predeformation in an original condition so that the first elastic component 102 can drive the tension roller 80 to a position where the tension roller 80 can press the photoconductive belt 54 when the actuating component 106 separates from the tension roller 80. That is, the first elastic component 102 pushes the tension roller 80 against the photoconductive belt 54 so as to sustain the photoconductive belt 54 to operate in a path stably. It can prevent the photoconductive belt 54 from loosing causing deviation of the photoconductive belt 54. The tension roller 80 presses the photoconductive belt 54 continuously for fixing the photoconductive belt 54 so as to provide tension for the photoconductive belt 54.

As shown in FIG. 6, when the releasing mechanism 104 is not electrified, the actuating component 106 of the releasing mechanism 104 can not move. If the elastic restoring force of the second elastic component 108 is greater than the elastic restoring force of the first elastic component 102, that is, the force that the second elastic component 108 pushes the actuating component 106 is greater than the force that the first elastic component 102 pushes the tension roller 80, the resultant force of the second elastic component 108 and the first elastic component 102 drives the actuating component 106 to move in the +X direction opposite to the −X direction so that the actuating component 106 drives the tension roller 80 to a position where the tension roller 80 can not press the photoconductive belt 54. That is, the tension roller 80 separates from the photoconductive belt 54 and can not press the photoconductive belt 54 so as to release the tension of the photoconductive belt 54.

Figure 7:
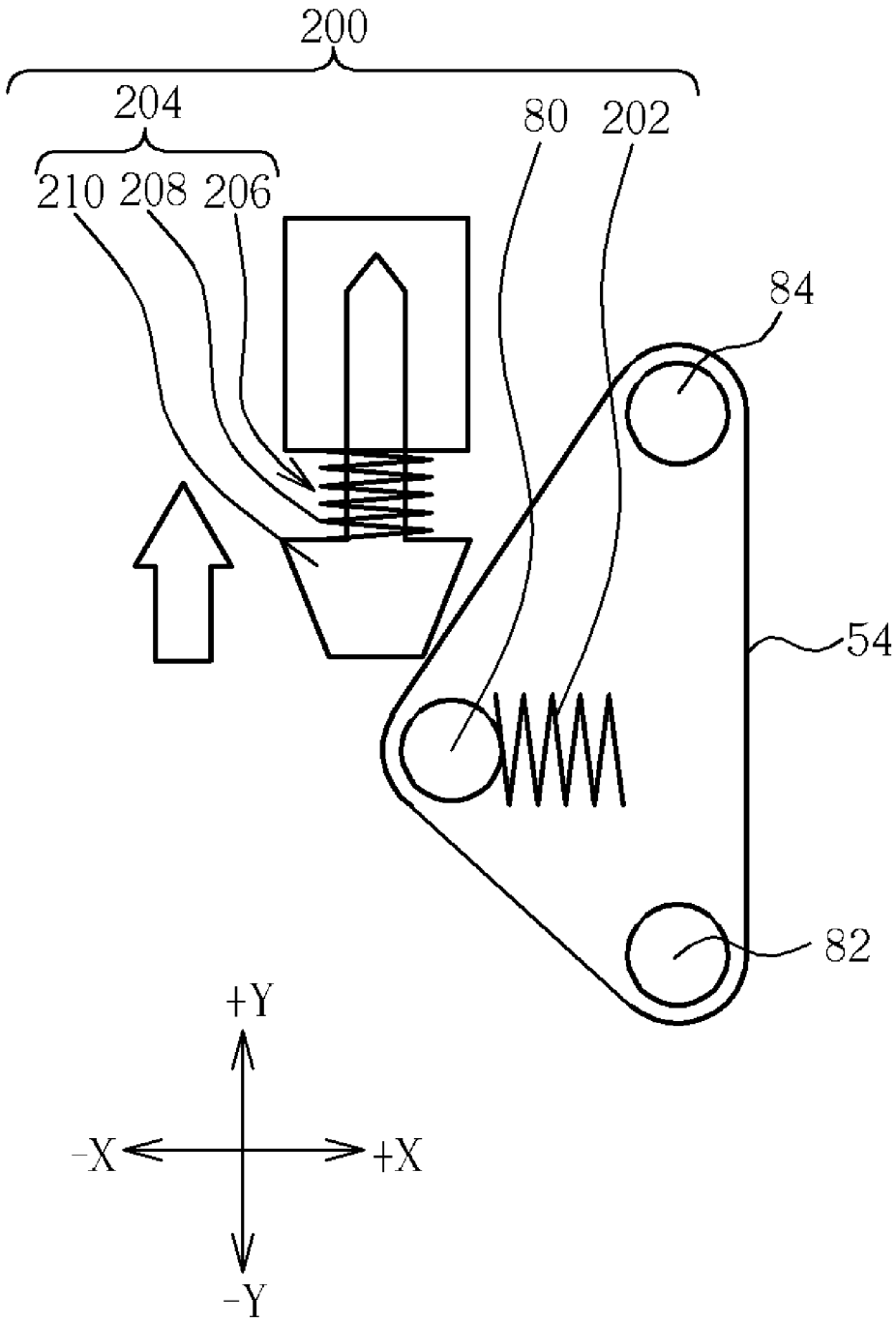
FIG. 7 is a diagram of a belt tension mechanism when the image forming device is printing according to a second embodiment of the present invention.
Figure 8:
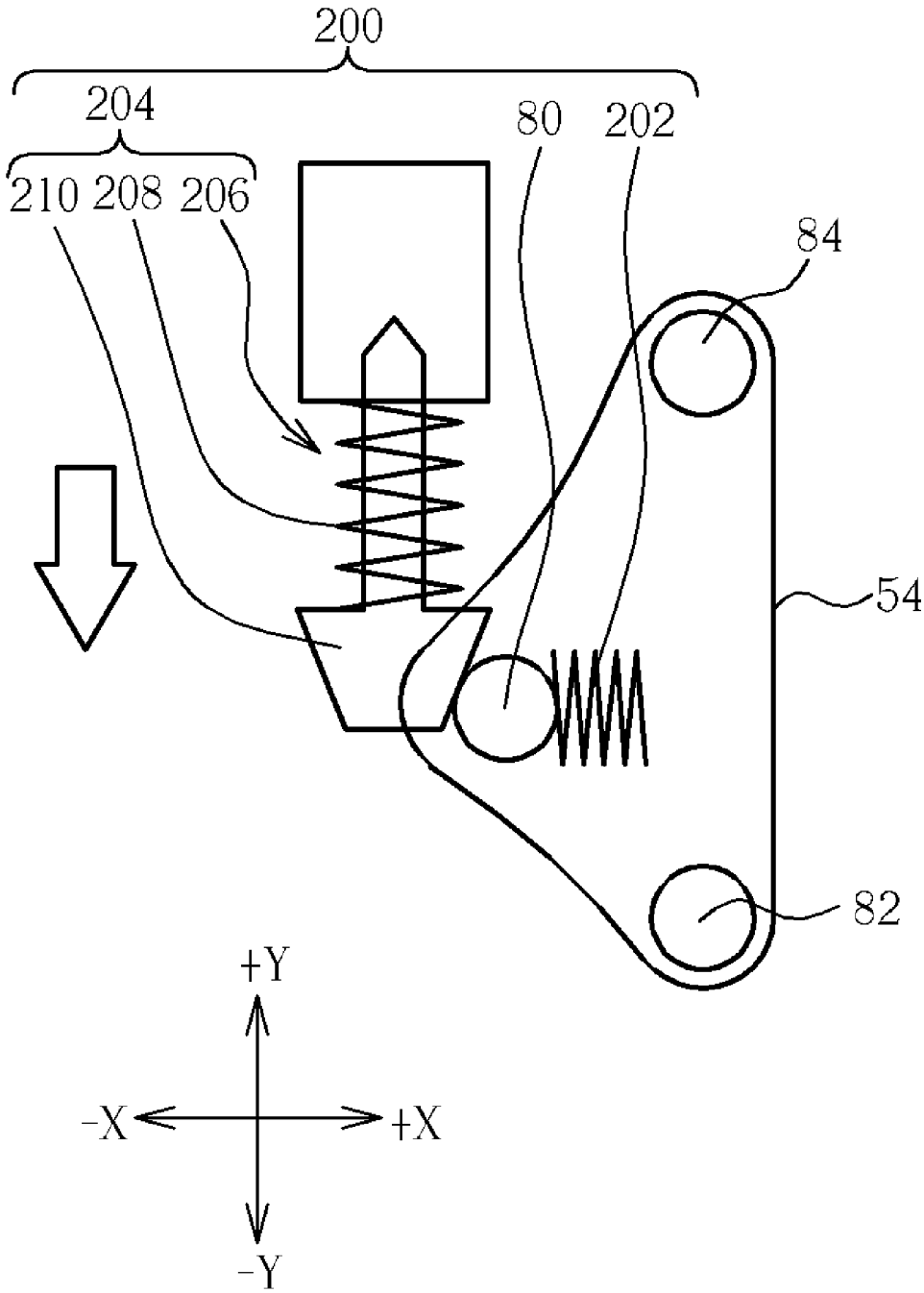
FIG. 8 is a diagram of the belt tension mechanism when the image forming device is not printing according to the second embodiment of the present invention.

Please refer to FIG. 7 and FIG. 8. FIG. 7 is a diagram of a belt tension mechanism 200 when the image forming device 50 is printing according to a second embodiment of the present invention. FIG. 8 is a diagram of the belt tension mechanism 200 when the image forming device 50 is not printing according to the second embodiment of the present invention. The belt tension mechanism 200 can be disposed on lateral sides of the photoconductive belt 54 for providing and releasing the tension of the photoconductive belt 54. The belt tension mechanism 200 includes the tension roller 80, a first elastic component 202, and a releasing mechanism 204. The releasing mechanism 204 includes an actuating component 206 and a second elastic component 208. The difference between the first embodiment and the second embodiment is that the actuating component 106 and the first elastic component 102 are parallel of the first embodiment and the actuating component 206 and the first elastic component 202 are not parallel or perpendicular of the second embodiment. The actuating component 206 includes a wedge structure 210 for driving the tension roller 80 to move in the +X direction perpendicular to the −Y direction when the actuating component 206 moves in the −Y direction.

As shown in FIG. 7, when the releasing mechanism 204 is electrified, the actuating component 206 of the releasing mechanism 204 moves in the +Y direction. Because the driving force in the +Y direction applied to the actuating component 206 is greater than the elastic force of the second elastic component 208, the wedge structure 210 of the actuating component 206 separates from the tension roller 80 and can not press the tension roller 80. The first elastic component 202 connected to the tension roller 80 has a predeformation in an original condition so that the first elastic component 202 can drive the tension roller 80 to a position where the tension roller 80 can press the photoconductive belt 54 when the actuating component 206 separates from the tension roller 80. That is, the first elastic component 202 pushes the tension roller 80 against the photoconductive belt 54 so as to sustain the photoconductive belt 54 to operate in a path stably. It can prevent the photoconductive belt 54 from loosing causing deviation of the photoconductive belt 54. The tension roller 80 presses the photoconductive belt 54 continuously for fixing the photoconductive belt 54 so as to provide tension for the photoconductive belt 54.

As shown in FIG. 8, when the releasing mechanism 204 is not electrified, the actuating component 206 of the releasing mechanism 204 can not move. The second elastic component 208 connected to the actuating component 206 applies an elastic restoring force to the actuating component 206 so as to drive the actuating component 206 to move in the −Y direction. When the actuating component 206 moves in the −Y direction, the wedge structure 210 of the actuating component 206 pushes the tension roller 80 to move in the +X direction perpendicular to the −Y direction. That is, the incline structure of the actuating component 206 can drive the tension roller 80 to move relative to the actuating component 206 perpendicularly. The normal force of the wedge structure 210 applied to the tension roller 80 is greater than the elastic force of the first elastic component 202 applied to the tension roller 80 so that the actuating component 206 is capable of driving the tension roller 80 to a position where the tension roller 80 can not press the photoconductive belt 54. That is, the tension roller 80 separates from the photoconductive belt 54 and can not press the photoconductive belt 54 so as to release the tension of the photoconductive belt 54.

Figure 9:
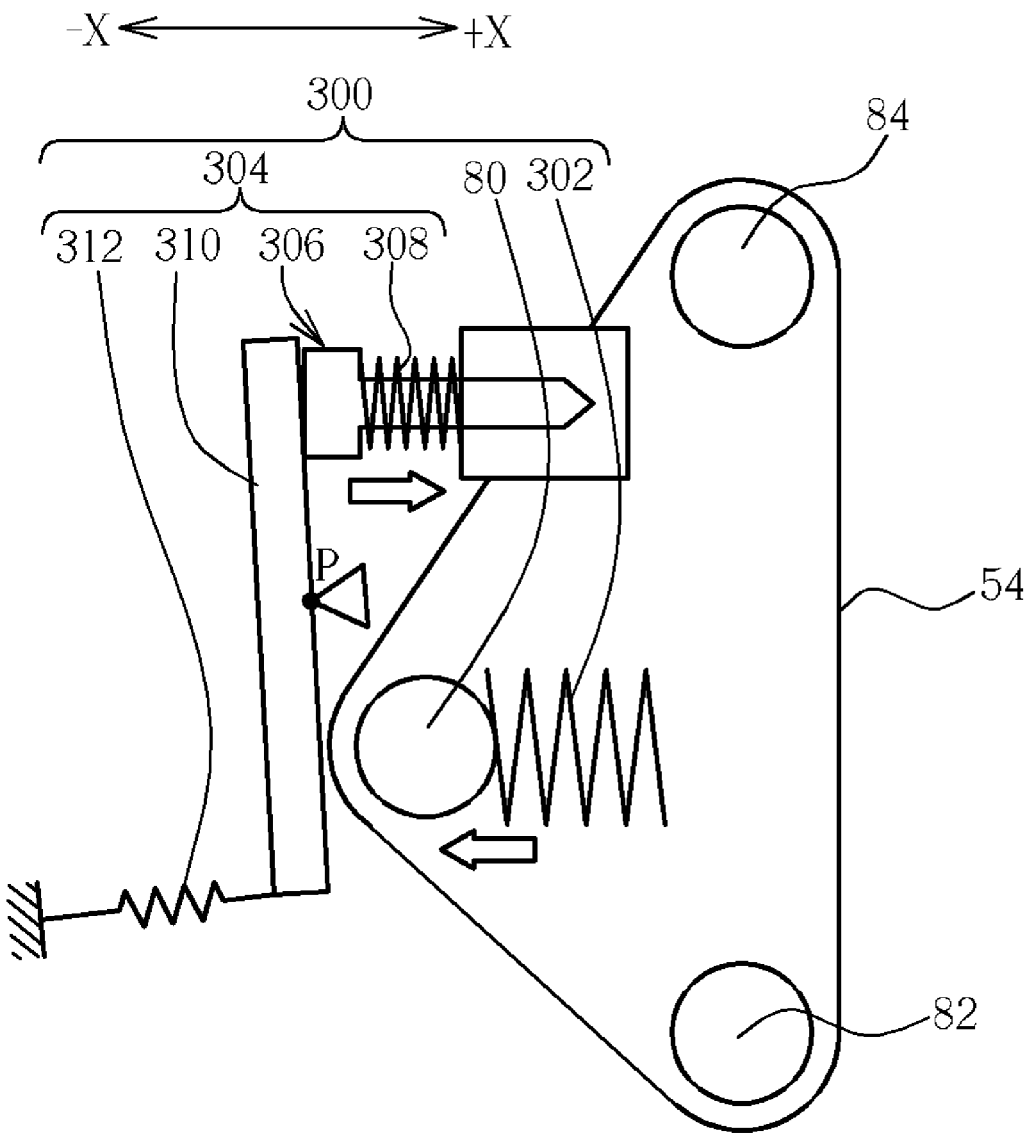
FIG. 9 is a diagram of a belt tension mechanism when the image forming device is printing according to a third embodiment of the present invention.
Figure 10:
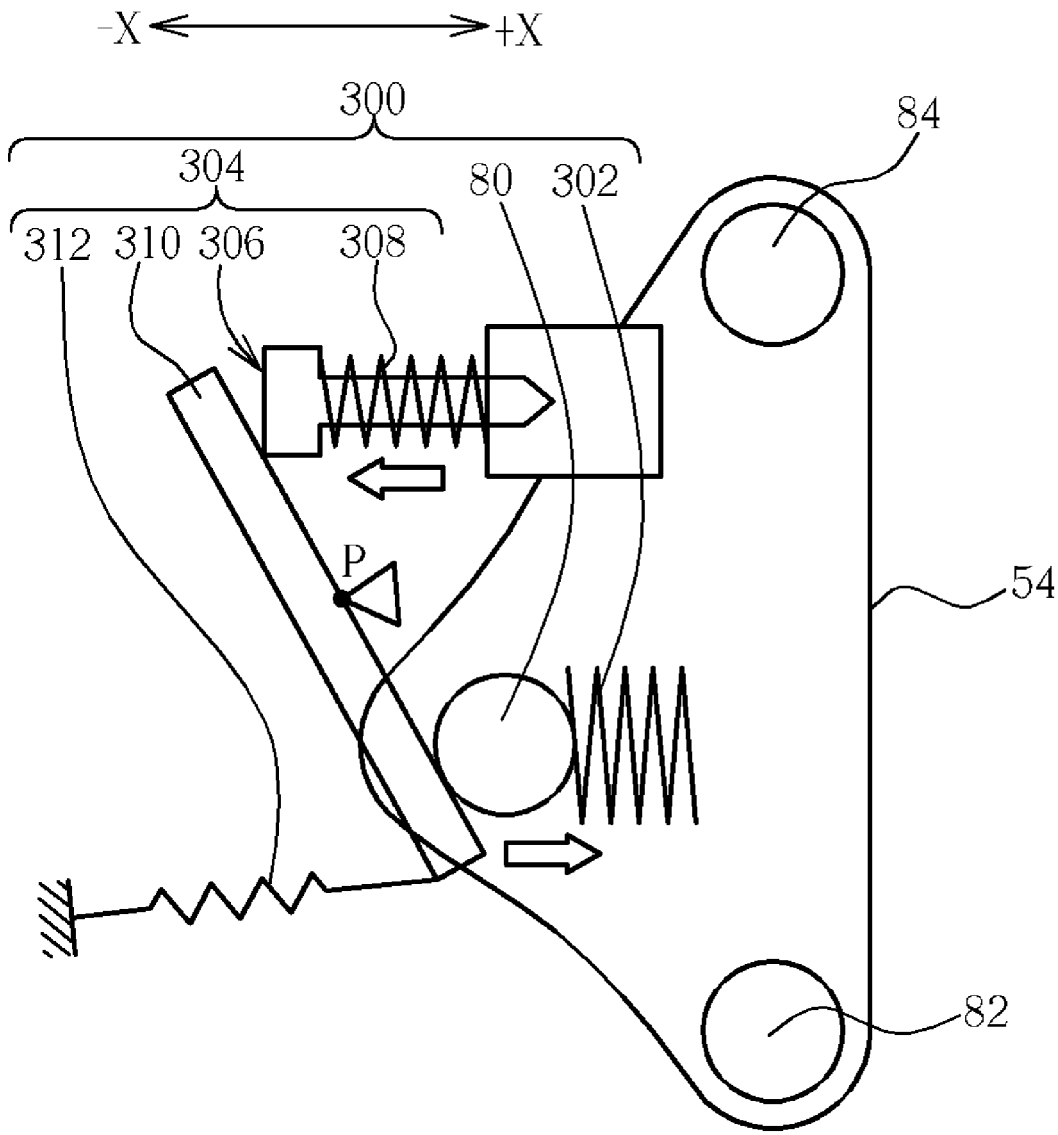
FIG. 10 is a diagram of the belt tension mechanism when the image forming device is not printing according to the third embodiment of the present invention.

Please refer to FIG. 9 and FIG. 10. FIG. 9 is a diagram of a belt tension mechanism 300 when the image forming device 50 is printing according to a third embodiment of the present invention. FIG. 10 is a diagram of the belt tension mechanism 300 when the image forming device 50 is not printing according to the third embodiment of the present invention. The belt tension mechanism 300 can be disposed on lateral sides of the photoconductive belt 54 for providing and releasing the tension of the photoconductive belt 54. The belt tension mechanism 300 includes the tension roller 80, a first elastic component 302, and a releasing mechanism 304. The releasing mechanism 304 includes an actuating component 306, a second elastic component 308, and a lever 310 connected to the actuating component 306. When an end of the lever 310 is pushed by the actuating component 306 in the −X direction, the other end of the lever 310 pushes the tension roller 80 to the position. The actuating component 306 can be a solenoid or a linear motor. The second elastic component 308 can be a spring. In the third embodiment, the actuating component 306 and the first elastic component 302 are parallel but not located in the same horizontal level, so the actuating component 306 drives the tension roller 80 by the lever 310.

As shown in FIG. 9, when the releasing mechanism 304 is electrified, the actuating component 306 of the releasing mechanism 304 moves in the +X direction. The driving force in the +X direction applied to the actuating component 306 is greater than the elastic force of the second elastic component 308. The releasing mechanism 304 further includes a third elastic component 312 connected to the other end of the lever 310 for pulling the other end of the lever 310 in the −X direction so as to separate the lever 310 from the tension roller 80 when the actuating component 306 moves in the +X direction. For example, the actuating component 306, such as the solenoid or the linear motor, can be designed to move in the +X direction when being electrified. When the actuating component 306 is not electrified, the actuating component 306 can not move. The first elastic component 302 connected to the tension roller 80 has a predeformation in an original condition so that the first elastic component 302 can drive the tension roller 80 to a position where the tension roller 80 can press the photoconductive belt 54 when the other end of the level 310 separates from the tension roller 80. That is, the first elastic component 302 pushes the tension roller 80 against the photoconductive belt 54 so as to sustain the photoconductive belt 54 to operate in a path stably. It can prevent the photoconductive belt 54 from loosing causing deviation of the photoconductive belt 54. The tension roller 80 presses the photoconductive belt 54 continuously for fixing the photoconductive belt 54 so as to provide tension for the photoconductive belt 54. In addition, the end of the level 310 can be pivoted to the actuating component 306 so that the actuating component 306 can drive the end of the level 310 to move in the +X direction when the actuating component 306 moves in the +X direction. The level 310 rotates relative to a fulcrum P, and the other end of the level 310 moves in the −X direction for separating from the tension roller 80, thus the third elastic component 12 can be omitted.

As shown in FIG. 10, when the releasing mechanism 304 is not electrified, the actuating component 306 of the releasing mechanism 304 can not move. If the moment relative to the fulcrum P of the resultant force of the driving force for the actuating component 306 in the −X direction and the elastic force of the second elastic component 308 is greater than the moment relative to the fulcrum P of the elastic force of the first elastic component 302, the resultant moment drives the tension roller 80 to a position where the tension roller 80 can not press the photoconductive belt 54. That is, the tension roller 80 separates from the photoconductive belt 54 and can not press the photoconductive belt 54 so as to release the tension of the photoconductive belt 54. The actuating component 306 can be disposed above or below the tension roller 80, a paper-proceeding direction, a paper-exiting direction, and so on, by the application of the level 310. The disposition of the releasing mechanism and the tension roller can be designed according to the inner space of the image forming device.

In conclusion, the tension roller is not constrained, as the actuating component separates from the tension roller, so that the first elastic component can push the tension roller against the photoconductive belt for sustaining the photoconductive belt when the image forming device is printing and the releasing mechanism is electrified. When the image forming device is not printing, as the image forming device is not electrified or shut down abnormally or the user inputs a signal to turn off the releasing mechanism, the second elastic component and the actuating component drive the tension roller to the position where the tension roller can not press the photoconductive belt. For example, the actuating component pushes the tension roller to separate from the photoconductive belt so as to release the tension of the photoconductive belt. It means that the photoconductive belt can be loosed when the image forming device is not utilized for avoiding torsion, deformation, and elasticity fatigue of the photoconductive belt so that the service life of the photoconductive belt and the print quality of the image forming device can be increased.

In contrast to the prior art, the belt tension mechanism and the related image forming device can drive the tension roller to a position where the tension roller can not press the photoconductive belt so as to release the tension of the photoconductive belt when the image forming device is not printing, as the image forming device is not electrified or shut down abnormally.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A belt tension mechanism comprising:

a tension roller disposed on the inside of a photoconductive belt for pressing the photoconductive belt so as to provide tension to the photoconductive belt;

a first elastic component connected to the tension roller for providing elastic force to the tension roller so that the tension roller adapted for tensioning the photoconductive belt; and a releasing device disposed on the outside of the photoconductive belt, the releasing device comprising:

an actuating component for moving in a first direction and separating from the tension roller when the actuating component is electrified so that the first elastic component drives the tension roller to a position where the tension roller provides tension to the photoconductive belt; and a second elastic component connected to the actuating component for driving the actuating component to a second direction opposite to the first direction when the actuating component is not electrified so that the actuating component drives the tension roller to a position where the tension roller does not provide tension to the photoconductive belt.

2. The belt tension mechanism of claim 1 wherein the first elastic component is a spring or a clip.

3. The belt tension mechanism of claim 1 wherein the second elastic component is a spring or a clip.

4. The belt tension mechanism of claim 1 wherein the actuating component is a solenoid or a linear motor.

5. The belt tension mechanism of claim 1 wherein the actuating component drives the tension roller to move in the second direction when the actuating component moves in the second direction.

6. The belt tension mechanism of claim 1 wherein the actuating component comprises a wedge structure for driving the tension roller to move in the second direction when the actuating component moves in a third direction not parallel to the second direction.

7. The belt tension mechanism of claim 1 wherein the releasing device further comprises a lever connected to the actuating component, and when an end of the lever is pushed by the actuating component in the second direction, the other end of the lever pushes the tension roller to the position where the tension roller can not press the photoconductive belt.

8. The belt tension mechanism of claim 7 wherein the end of the lever is pivoted to the actuating component.

9. The belt tension mechanism of claim 7 wherein the releasing device further comprises a third elastic component connected to the other end of the lever for pulling the other end of the lever in the second direction when the actuating component moves in the first direction.

10. The belt tension mechanism of claim 1 further comprising:

a drive roller disposed on the inside of the photoconductive belt for driving the photoconductive belt to rotate; and an idle roller for sustaining the photoconductive belt with the tension roller and the drive roller.

11. An image forming device comprising:

a housing;

a photoconductive belt installed inside the housing in a rotatable manner;

a drive roller for driving the photoconductive belt to rotate;

a tension roller disposed on the inside of the photoconductive belt for pressing the photoconductive belt so as to provide tension to the photoconductive belt;

a first elastic component connected to the tension roller for providing elastic force to the tension roller so that the tension roller is adapted for tensioning the photoconductive belt;

and a releasing mechanism disposed on the outside of the photoconductive belt opposite to the tension roller relative to the photoconductive belt, the releasing mechanism comprising:

an actuating component for moving in a first direction and separating from the tension roller when the actuating component is electrified so that the first elastic component drives the tension roller to a position where the tension roller provides tension to the photoconductive belt; and a second elastic component connected to the actuating component for driving the actuating component to a second direction opposite to the first direction when the actuating component is not electrified so that the actuating component drives the tension roller to a position where the tension roller does not provide tension to the photoconductive belt.

12. The image forming device of claim 11 wherein the first elastic component and the second elastic component are springs or clips.

13. The image forming device of claim 11 wherein the actuating component is a solenoid or a linear motor.

14. The image forming device of claim 11 wherein the actuating component drives the tension roller to move in the second direction when the actuating component moves in the second direction.

15. The image forming device of claim 11 wherein the actuating component comprises a wedge structure for driving the tension roller to move in the second direction when the actuating component moves in a third direction not parallel to the second direction.

16. The image forming device of claim 11 wherein the releasing device further comprises a lever connected to the actuating component, and when an end of the lever is pushed by the actuating component in the second direction, the other end of the lever pushes the tension roller to the position where the tension roller can not press the photoconductive belt.

17. The image forming device of claim 16 wherein the end of the lever is pivoted to the actuating component.

18. The image forming device of claim 16 wherein the releasing device further comprises a third elastic component connected to the other end of the lever for pulling the other end of the lever in the second direction when the actuating component moves in the first direction.

19. The image forming device of claim 11 further comprising an idle roller for sustaining the photoconductive belt to move along a path with the tension roller and the drive roller.

* * * * *